United States Patent [19]

Pearce, III

[11] Patent Number: 4,823,986

[45] Date of Patent: Apr. 25, 1989

[54] DELAYED TIME ACTUATION FOR TOTAL-RELEASE CONTAINERS AND SIMILAR DEVICES

[75] Inventor: Robert C. Pearce, III, Arlington, Tex.

[73] Assignee: Sandoz Ltd., Basel, Switzerland

[21] Appl. No.: 154,779

[22] Filed: Feb. 10, 1988

Related U.S. Application Data

[63] Continuation-in-part of Ser. No. 926,287, Nov. 3, 1986, abandoned, which is a continuation-in-part of Ser. No. 790,925, Oct. 24, 1985, abandoned.

[51] Int. Cl.[4] ..... B67D 5/08

[52] U.S. Cl. ..... 222/54; 222/182; 222/402.14; 222/1; 137/67

[58] Field of Search ..... 137/67, 72, 74; 222/52, 222/54, 182, 402.14, 477, 1; 169/9, 57, 72, 74, 36

[56] References Cited

U.S. PATENT DOCUMENTS

| | | | |
|---|---|---|---|
| 2,244,302 | 6/1941 | Lynn et al. | 222/54 |
| 2,297,690 | 10/1942 | Nitardy | 222/92 X |
| 2,759,768 | 8/1956 | Sato | 222/54 X |
| 3,399,806 | 9/1968 | Lucas | 137/67 |
| 3,765,573 | 10/1973 | Landsman | 222/182 |
| 3,800,878 | 4/1974 | Poitras | 137/72 X |
| 3,961,669 | 6/1976 | Kaneko | 169/74 X |
| 4,121,734 | 10/1978 | Soong et al. | 222/54 |
| 4,426,025 | 1/1984 | Knickerbocker | 222/182 |
| 4,522,322 | 6/1985 | Guntermann et al. | 222/597 |

FOREIGN PATENT DOCUMENTS

| | | | |
|---|---|---|---|
| 805525 | 3/1951 | Fed. Rep. of Germany | 222/54 |

*Primary Examiner*—Michael S. Huppert
*Attorney, Agent, or Firm*—Jacqueline S. Larson

[57] ABSTRACT

Time-delayed propellant device for release of an active agent from the device by materials which are susceptible to displacement by various actuating factors in the propellant device.

21 Claims, 2 Drawing Sheets

DELAYED TIME ACTUATION FOR TOTAL-RELEASE CONTAINERS AND SIMILAR DEVICES

This is a continuation-in-part of application Ser. No. 926,287, filed on Nov. 3, 1986, now abandoned, which is a continuation-in-part of application Ser. No. 790,925, filed on Oct. 24, 1985, now abandoned.

BACKGROUND OF THE INVENTION

1. Field of the Invention

This invention relates to time-delayed propellant devices. More particularly, it relates to the delayed release of an active agent from a propellant-type device by employing materials susceptible to displacement by various actuating factors present in the propellant device.

More particularly, the present invention employs materials susceptible to displacement at ambient temperature by an actuating factor such as a compressed propellant or a solvent.

2. Related Disclosures

Devices which allow for the total or partial release of an active agent from a propellant device, e.g., aerosol containers, are known. These devices are in the form of valves, overcaps, actuators, button lock action devices and the like. Examples of these devices may be found in U.S. Pat. Nos. 4,426,025, 3,765,573, and in the *Handbook of Aerosol Technology,* 2nd Ed., page 85, Kreiger Publ.

The main disadvantage of the total-release containers is their immediate actuation which exposes the operator to the often hazardous, noxious or unpleasant contents of the containers. Thus, devices with delayed actuation are desirable to prevent direct contact of the operator with the content of the container.

Some attempts for delayed release of the content of various containers were made previously. The resulting devices are mostly applicable and/or suitable for specific purpose only.

Dispensers with delayed opening of a water-soluble seal which dissolves when coming in contact with water in the washing machine are described in U.S. Pat. No. 3,399,806. Such dispensers also contain a second seal between the water-soluble seal and the dispensers, contents, which second seal must be broken or removed mechanically by the operator in order for the water-soluble seal to become functional.

U.S. Pat. No. 3,800,878 describes a fire extinguisher utilizing a temperature-responsive eutectic material in conjunction with an auxiliary seal that isolates the eutectic material from the pressurized fluid of the container. The eutectic material exposed to the heat melts and releases the pressurized content of the container which, in turn, opens the auxiliary seal. The combination such as one described above can be only used for certain types of containers, such as sturdy fire extinguishers, as it is rather dangerous to employ together such actuation stimuli as heat and pressure because the heat increases the pressure in the container which may break and/or explode.

Another device disclosed in U.S. Pat. No. 2,759,768 and useful for atomizing pressurized gas or liquid insecticides also combines two elements for its delayed release. This device comprises a solvent-soluble shutter plate positioned between the nozzle and the interior of the bomb. The shutter plate is supplemented with a lining membrane susceptible to pressure but resistant to the solvent. Structurally, the device is rather complicated in that it needs a build-in spring underneath said shutter to push the shutter through the perforator. Also, before the unit can be activated, the solvent needs to be poured manually into the nozzle cylinder, making it impractical for ordinary use. First, the solvent needs to be stored separately; second, manually adding the solvent to the nozzle is time-consuming; and third, it exposes the operator to the solvent. In alternative, the disclosed device uses a built-in knife which cuts the base of the box filled with a solvent. Again, the device with a built-in knife is structuraly complicated, more expensive to manufacture and impractical to handle.

A container for dispensing fumigants employing a kind of delayed actuation is disclosed in U.S. Pat. No. 2,244,302. The delayed release is caused by melting of the low-melting metal alloy plug sealing the outer tube of the container. Surrounding, the seal is the ring of solid combustible material or some other flammable material. To release the contents of the container it is necessary to manually ignite the combustible material which then generates heat, which heat fuses the metal seal of low-melting alloy. This kind of heat-sensitive plug can only be used for containers of which the contents are not explosive and flammable and those containers which are not under pressure. It also requires the operator to ignite the material which creates the danger of starting a fire.

The present invention provides a simple, inexpensive, safe, effective, practical and easy-to-handle means for delayed actuation, avoiding at the same time the disadvantages of the previously known total-release devices. It provides a time-delayed actuation and release for all kinds of total-release propellant type devices such as foggers, fumigators, insecticidal sprays and bombs, paint capsules, gas bombs, aerosols, oven cleaners, tear gas grenades, smoke grenades, explosives and other devices without involving unnecesary, impractical or hazardous steps. Many of these propellant devices could not be activated by the previously disclosed mechanisms.

SUMMARY

The main aspect of this invention is the time-delayed actuation for total release containers and/or other similar devices, which time-delayed actuation is caused by placing a material susceptible to an actuating factor in removable association with a valve, valve stem, actuator or with an overcap. Upon mechanical actuation of the valve and valve actuator which would normally trigger instantaneous release of the container's contents, such release is not instantaneous but is delayed for a certain period of time by material susceptible to an actuating factor present in the container content. After the actuating factor comes into contact with the material susceptible to the actuating factor and displaces it over a period of time, the contents of the container are released.

In the featured embodiments of the invention, the material susceptible to the actuating factor is chosen from adhesive tapes, greases, parafilms, polyethylene, or various formulations of polymer resins with plasticizers.

DETAILED DESCRIPTION OF THE INVENTION

This invention is premised on the finding that certain susceptible materials when placed in association with a valve, valve stem, actuator or the container's overcap may, in time and with certain delay, be displaced at ambient temperature by rupturing, dissolving or otherwise disintegrating due to various actuating factors. The actuating factors may be the propellant, pressure, solvent, gas, smoke, active ingredient and other like factors.

The time-delayed displacement/actuation is brought on by a total release or continuous spray propellant device having a container body with a valve and valve actuator on the terminal orifice of the container or which is covered with a dual-function overcap wherein a material susceptible to an actuating factor in the container body is placed in removable association with the valve, valve stem, actuator or with the overcap.

Upon engagement of the valve, actuator, or container's overcap, the actuating factor in the container is brought into contact with the susceptible material which begins to affect said susceptible material, eventually causing the material to fatigue and be displaced allowing the delayed release of the container's contents.

Definitions

As used herein, the term:

"Ambient temperature" means room temperature and is normally within the range of 4.5° C. to 38° C.

"Container" means and includes aerosols such as oven cleaners, foggers, fumigators, insecticidal sprays and bombs, paint capsules, gas bombs, tear gas grenades, containers containing explosives and other devices of a similar type.

"Actuating factor" means and includes the propellant, internal pressure of the container, smoke, formulation solvents, or active agents in the container such as fumigating agents, germicides, herbicides, insecticides, pesticides, anesthetic agents, tranquilizers, various chemicals and gases and paint, or any of the above factors in combination.

"Compressed propellant" means an essentially nontoxic aeroform fluid capable of exerting pressure when held in a sealed container at room temperature, which fluids boil at or below 40.6° at normal atmospheric conditions and are capable of expelling the contents of an aerosol container.

"Time delay" means a time period during which the actuating agent affects the material, i.e. from the moment when the actuator or valve is engaged and allows the actuating agent to come in contact with a material susceptible to such actuating factor, until the time when such material ruptures, dissolves or otherwise disintegrates.

"Material susceptible to actuating factor" means any of the following materials:

scotch tapes, such as tapes known under trade names Scotch® 810, Scotch® CW 71544AAV 4152, R-Tape® (Cl-PAN), silver cloth tape also known as duct tape;

various greases such as silicone grease;

sealants;

parafilm of various thickness;

polyethylene and similar materials;

polyolefins such as polyvinyl chloride;

resins such as those known under the trade names Piccopale® resins, particularly Piccopale® 100-SF, Nevtac® resins, particularly Nevtac® 99 and 100, and all the above resins alone or in combination with various plasticizers and other formulating agents.

DESCRIPTION OF THE DRAWINGS

These and other features and objects of the present invention will become more apparent upon a perusal of the following description taken in conjunction with the accompanying drawings wherein:

FIG. 1 is a schematic drawing of sectional view, illustrating one preferred embodiment of this invention, i.e. a total release overcap wherein the material susceptible to the actuating factor is placed either "on" or "in" the orifice of the overcap.

FIG. 3 is a schematic drawing of sectional view, illustrating another preferred embodiment of this invention, i.e. a button-lock actuator wherein the material susceptible to the actuating factor is placed either on or in the orifice of the button-lock actuator.

Referring to FIGS. 1A, 1B and 1C, the total release overcap (U.S. Pat. No. 4,426,025) is shown with the material 1 susceptible to the actuating factor placed either on or in the orifice 2 of the overcap.

In operation, the cap which normally serves as a cover for shipping or storing is inverted and locked to the valve of the can containing internal actuating factor. Thereupon the content of the container being released interacts with the material susceptible to the actuating factor and begins to actuate such material until it is displaced. Only then is the content of the can released.

Figure 1A:
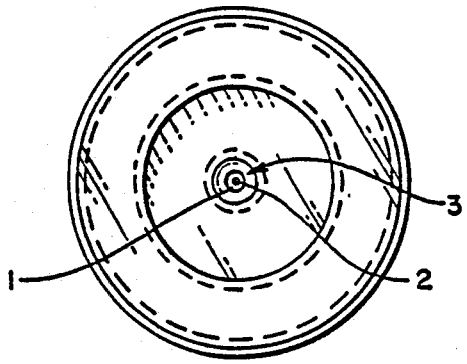
FIG. 1A is a plane view of the top of the overcap.
Figure 1B:
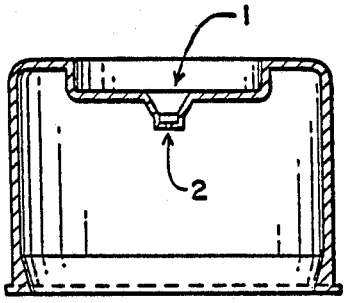
FIG. 1B is a side sectional view of said overcap.
Figure 1C:
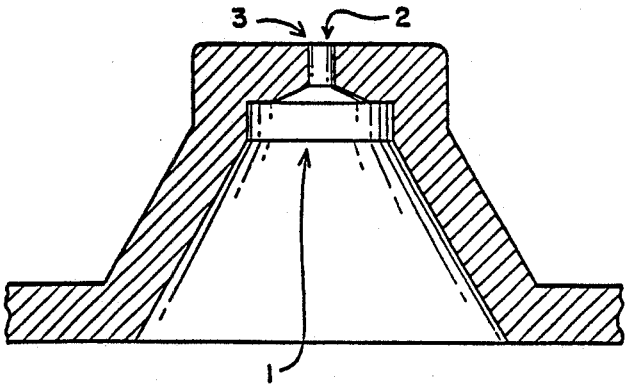
FIG. 1C is an enlarged view of the middle section of the overcap in a position in which it is used for delayed actuation.
Figure 2:
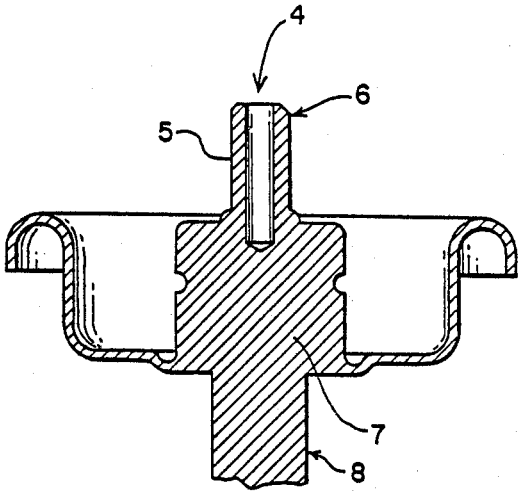
FIG. 2 is a schematic drawing of sectional view, illustrating the other preferred embodiment of this invention, i.e. an aerosol valve wherein the material susceptible to the actuating factor is placed either on or in the orifice of the valve stem.

Referring now to FIG. 2, the aerosol valve (*Handbook of Aerosol Technology,* supra at 85) is shown with the material 3 susceptible to the actuating factor placed either on or in the orifice 4 of the valve stem 5 of the aerosol valve assembly. FIG. 2 is a side sectional view of the aerosol valve assembly showing the stem 5, body of the valve 6, and diptube 7

In operation, whenever the actuator attached to the valve stem of the container is engaged, the content of the container is released. Then, the content containing the actuating factor interacts with the material susceptible to the actuating factor placed in or on the valve stem and begins to actuate such material until it is displaced. Only then is the content of the can released.

Figure 3A:
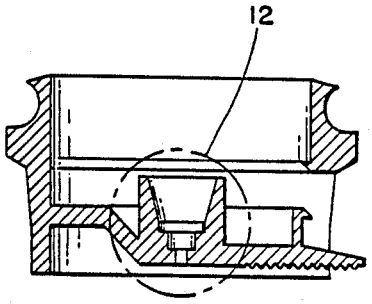
FIG. 3A is a side sectional view of the whole actuator and FIG. 3B is an enlarged view of the middle section 10 of the overcap.
Figure 3B:
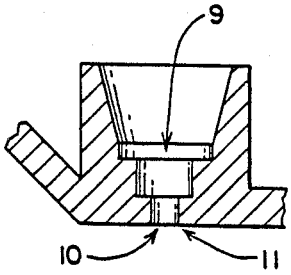

Referring now to FIG. 3B, the button-lock actuator (*Handbook of Aerosol Technology,* supra at 111) is shown with the material 8 susceptible to the actuating factor placed either on or in the orifice 9 of the actuator.

In operation, whenever the actuator attached to the valve stem of the container is engaged, the content of the container is released. Then, the content containing the actuating factor interacts with the material susceptible to the actuating factor placed in or on the orifice of the actuator and begins to affect such material until it is displaced. Only then is the content of the can released.

Susceptible materials are either placed between a valve and an actuator, or built in or on an actuator or a valve stem of the total-release container. The delayed actuation is triggered by engaging the actuator or by opening the valve. After the actuator or valve is so engaged, the actuating factor begins to affect the susceptible material and eventually in time causes the material to fatigue and be displaced allowing the delayed total-release of the contents of the propellant device. The delay in time depends on the material used and on the actuating factor.

PREFERRED EMBODIMENTS

One preferred embodiment of this invention is a device in which the material susceptible to actuating factors is placed in or on the container's valve, the valve stem or the actuator, or in or on the orifice of the overcap.

A more preferred embodiment of this invention is the above device wherein the material susceptible to actuating factors is parafilm, polyethylene, polyvinyl chloride or formulated polymer resin with plasticizer or solvent and wherein the actuating factor is pressure, propellant or solvent.

The most preferred embodiment of this invention is the device wherein the material susceptible to actuating factors is parafilm, or polyethylene, polyvinyl chloride or polymer resin in an amount from 79–83 wt/% formulated with plasticizer in an amount from 17–21 wt/%.

PREPARATION PROCEDURES

The device of this invention is prepared by placing a material susceptible to actuating factors in or on the valve, the valve stem or the orifice of the overcap or actuator of any total-release container.

Almost all total-release containers can be used and modified to a delayed actuation total-release device. The examples of such containers were already given in the definitions.

Valves into which stem the susceptible material is placed are the typical aerosol or container valves. This invention encompasses all common and general types of valves as well as special application valves, valves used for metal, plastic or glass containers.

The delayed actuation material can be placed either in or on the valve, preferably the valve stem, into the stem orifice(s), if there are any, in the wall of the stem or in the stem seat (spring cap). The details describing the different types of valves, valve stems and various other parts thereof can be found in *Handbook of Aerosol Technology*, supra, pp. 85–111.

Similarly, the delayed actuation material can be placed in or on the actuator of any size or shape. Actuators and their functions are generally described in *Handbook of Aerosol Technology*, supra, pp. 111–114.

Similarly, the delayed actuation material can be placed also in or on the orifice made into a total-release overcap.

Although only valves, overcaps and actuators are described in detail herein, it is understood that the actuator overcaps, compound actuator buttons, all the above with or without locks and/or any combination of all those above are also covered in this invention.

The orifice can be of various shapes and sizes and is made either by drilling, pinching, or perforating the existing valve, overcap or actuator, or the valve or actuator can be made by molding a plastic material into a form allowing for such an orifice.

The material susceptible to actuation can be placed in an orifice of any kind, variety, size and shape in such an amount which will completely fill, block and cover the orifice and in some instances it may also cover its surroundings.

The material susceptible to actuation can be any material which can be placed in or on the orifice/opening, the valve, the valve stem, the overcap, the actuator or between them and will react with certain delay to actuating factors. The examples of the delayed actuation material are any adhesive material such as scotch tapes, for example Scotch® 810, Scotch® CW 71544AAV 4152, R-Tape® (Cl-PAN), silver cloth tape also known as duct tape, preferably Scotch® 810 and silver cloth tape; various greases such as silicone grease, parafilm of various thickness, preferably 0.005–0.015 inch thickness; polyethylene and materials similar to it; polyvinyl chloride; aliphatic hydrocarbon resins; waxes; elastomers; polypropylene; ethylene ethyl acrylates; ethylene vinyl acetate; polyvinyl acetate; butyl acrylate; rubbers; polyisoprene; polystyrene; polyvinyl acetal; polyvinyl ethyl ether; various polymer resins such as those generally known under the trade name Piccopale® 100 resins, preferably Piccopale® 100-S (available from Hercules, Inc., Wilmington), Nevtac® resins (available from Neville Chemical Company), preferably Nevtac® 99 or 100; or any other material which would be suitable for such application, all the above alone or in combination with various formulating agents such as solvent or plasticizers, for example dibutyl phthalate, dicyclohexylphthalate, diethyl phthalate, diisodecylphthalate, dimethyl phthalate, diphenyl phthalate, dioctyl phthalate, diundecyl phthalate, dioctyl adipate butyl benzyl phthalate, dialkyl phthalate (known under the trade name Santicizer 711), dialkyl adipate (Santicizer 97), polymeric type Santicizer 261, 409, 411, 412, 429, 480, 481, 482, 334F, 79TM-trimellitate type, preferably dioctyl phthalate (DOP), butyl benzyl phthalate Santicizer 160 (BBP) and dioctyl adipate (DOA).

Most preferably, the material susceptible to actuation is polyethylene, polyvinyl chloride or polymer resins alone or in combination with a plasticizer.

Polymer resin and plasticizers for polymers are mixed in a ratio from 50:50 to 90:10, preferably from 70:30 to 80:20, depending on the type of resin and plasticizer used. More preferably, the ratio is from 79:21 to 83:17.

The material susceptible to actuation can be formulated with other appropriate and acceptable formulating agents such as various fluorescent dyes, i.e. fluorescent orange, fluorescent yellow, fluorescent blue, fluorescent red, fluorescent black.

The susceptible material is either inserted into the orifice manually, or is injected, hot molded, dip-coated or coated in the valve, the valve stem, the actuator or at the interface of the valve and actuator or in the overcap, in the orifice only, or to the orifice and its surroundings, or it is applied to the orifice or to its vicinity or under or above the orifice by using hot molding techniques well known in the art.

UTILITY

The current invention is useful for any kind of administration and total-release of harmful, hazardous, poisonous, noxious or unpleasant contents of various containers and similar devices to the surrounding environment, which administration could be otherwise harmful, unpleasant, impractical or risky to the operator of such device. In such situations, time is needed to get away from the container before it releases its contents.

The device of this application allows the application of various pesticides, fumigating agents, even hazardous materials which normally cannot be applied without safety hazards, without complicated health protections such as masks, respirators, special clothes, etc. Sometimes, such materials cannot be applied at all without substantial health risk to the operator.

Utilizing this invention, the operator of a device containing any kind of harmful substance installs the device in the appropriate place, engages the actuator, the valve or other triggering unit and leaves. The material now comes in contact with the actuating agent which slowly reacts with the material susceptible to that particular agent. In due time (controlled by choice of materials, thickness, formulation, dimensions and location), such material fatigues and is displaced, thus opening the orifice in the system and allowing the contents of the container to be released to the vicinity.

The device of this invention can be similarly used to activate fire extinguishers in a case of unattended fire, tranquilize wild animals or disturbed or violent people without endangering personnel, administer various detoxicants, disinfectants, anesthetic agents and other agents of a similar type. Uses such as a landing area marker or a rescue markersite is also possible.

The following examples are intended to illustrate the current invention. They are not to be interpreted as limiting the current invention to the material appearing in the examples.

Example 1

Delayed Actuation - Unformulated Materials

This example illustrates a delayed actuation using various containers, actuating agents and unformulated materials susceptible to actuation.

I. Adhesive Tapes

An adhesive disk of one of the materials listed below was placed over/on an exit orifice of a total release actuator of pressurized insecticide/solvent-containing room fogger. Then the actuator was engaged and the time delay in which the actual release from the container occurred was measured.

| Material | Delay Time: |
|---|---|
| Scotch ® 810 | 3.0 sec |
| Scotch ® CW71544AAV 4152 | 1.5 sec |
| R-Tape ® (Clean) | 2.5 sec |
| Silver cloth tape | 3.0 sec |

Depending on the tape material, the solvent and/or the pressure from the fogger was able to disintegrate the tape within 1.5 to 3 seconds.

II. Greases

Grease was placed in the valve stem of the aerosol container, the valve was opened and the time delay of the actuation was measured.

| Material | Delay Time |
|---|---|
| Silicone Grease | 1 sec |

The pressure of the aerosol was able to push the grease through the orifice in approximately 1 second.

III. Parafilm ®

A piece of parafilm of various thicknesses was placed at the interface of a valve stem and actuator of the generally available insecticidal total-release bomb fogger and the delayed actuation was measured.

| Material Parafilm: | Delay Time |
|---|---|
| thickness .005" | 8.0 sec |
| thickness .010" | 25–80 sec |
| thickness .015" | 5 min |

By changing the thickness of the material, it is possible to regulate the time delay of release.

IV. Polyethylene

High density polyethylene film (3/1000 inch sheet) obtained from DuPont, was installed at the interface of the valve and actuator of a room fogger and the time delay measured.

| Material | Delay Time |
|---|---|
| Polyethylene | No actuation in 60 min |

Polyethylene material did not rupture, dissolve or disintegrate for at least 60 minutes of the experiment.

V. Other Materials

Using the procedure of sections I–IV of this example, the time delay of other types of containers and other materials are determined.

Example 2

Delayed Actuation - Formulated Materials

This example illustrates a delayed actuation using various containers, actuating agents and formulated materials susceptible to actuation.

I. Polymer Resins/Plasticizers

Combinations of polymer resins/plasticizers (Formulation) have been prepared in the formulations listed below:

| | Formulation | | | |
|---|---|---|---|---|
| Raw Materials | 1 Batch | 2 Batch | 3 Batch | 4 Batch |
| Piccopale ® 100-SF | 10 | 8.0 | 7.6 | 8.3 |
| D.O.A. | — | 2.0 | 3.4 | 1.7 |
| FD&C Blue | — | 0.1 | — | — |
| FD&C Red | — | — | 0.1 | — |
| FD&C Black | — | — | — | 0.1 |
| | 10 | 10.1 | 11.1 | 10.1 |

D.O.A. means dioctyl adipate;
FD&C means Food, Drugs & Cosmetics.

All formulations prepared according to the above schedule were heated until molten, then placed on and over the orifice at the underside of the fogger actuators (20 of each formulation). The actuators with placed formulations on the orifice were allowed to cool to ambient temperature. Then the actuator was engaged and the time delay in which the actual release from the container occurred was measured.

Fogger actuators used in this example were a standard button-lock type (total release button-lock type actuator Cat. No.01-3686 obtained from Precision Valve Corp., Yonkers, N.Y.), and a standard overcap (total release overcap Cat. No. C82-0118-00 obtained from Seaquist, Division of Pittway Corp., Cary, Il.).

The fogger actuator cap was also obtained from Seaquist.

| Formulation | Delay Times | No. of Trials |
|---|---|---|
| 1 | more than 6 hours | 5 |
| 2 | from 1:44 min to 2:04 min | 5 |
| 3 | from 25 sec to 34 sec | 5 |
| 4 | from 13:27 min to 15:12 min | 5 |

The above formulations produced a small resin worm which passed through the fogger actuator until all of the resin/plasticizer formulation which blocked the orifice was expelled. Due to solvent and/or pressure effects on the resin/plasticizer formulation, the formulation ruptured and allowed total-release of the contents of the fogger.

II. Polymer Resins/Plasticizers a. In these formulations, the ratios of plasticizer to polymer resin were as follows:

| | Formulations | |
|---|---|---|
| Raw Materials | 5 (wt/%) | 6 (wt/%) |
| Piccopale ® 100SF | 80.20% | 81.20% |
| D.O.A. | 18.80% | 17.80% |
| Fluorescent Orange | 1.00% | — |
| Fluorescent Yellow | — | 1.00% |
| | 100.00% | 100.00% |

These formulations were inserted in an amount from 0.010–0.002 g, into the bottom side orifice of a button-lock actuator and in Seaquist overcap actuators. The time delay of total-release was measured after the actuator was engaged.

| Formulation | Delay Times | No. of Trials |
|---|---|---|
| | Button-Lock Actuator | |
| 5 | from 1:48 min to 2:30 min | 6 |
| 6 | from 12 min to 16:04 min | 6 |
| | Seaquist Cap Actuator | |
| 5 | from 1:44 min to 2:11 | 6 |
| 6 | from 13:41 min to 16:10 min | 6 |

b. Other formulations in amount 0.001–0.100 g are inserted into an orifice of any actuator depending on formula ratio and the time delay following the actuation is determined.

III. Other Formulations

Following the above procedure, the other combination formulations are prepared and tested for time delayed actuation of total-release containers of various types.

Example 3

Formulation Process

Formulations useful for delayed actuation were prepared by mixing D.O.A. with fluorescent dye, for example fluorescent orange or fluorescent yellow or with blue, red, black or other dye pigments. The mixture was heated up to 100° C. Then, the polymer resin was added and the whole mixture was heated up to 100° C. again until it was molten and homogenous. In the molten stage it was applied to the actuator, the valve or the orifice of the total release container.

What is claimed is:

1. In a continuous-spray propellant device having a container with a valve stem, a valve and a continuous valve actuator for discharging the container contents through a terminal orifice of the container, the improvement which comprises having in removable association with the valve stem, the valve and the valve actuator, a material susceptible to displacement at ambient temperature by an actuating factor in the container, whereby when the valve is actuated, the susceptible material is displaced by the actuating factor over a period of time, thereby delaying the release of the container product.

2. A device according to claim 1 wherein the actuating factor is compressed propellant or a solvent or a combination of compressed propellant and solvent.

3. A device according to claim 2 wherein said material susceptible to the displacement is selected from a group consisting of a parafilm, polyethylene and a formulated combination of polymer resin and plasticizer.

4. A device according to claim 3 wherein said material is a formulated combination of a polymer resin and a plasticizer.

5. A device according to claim 4 wherein the polymer resin and the plasticizer are present in an amount from 79 wt/% to 83 wt/% of the polymer resin and 17 wt/% to 21 wt/% of the plasticizer.

6. A device according to claim 3 which device is an aerosol.

7. A device according to claim 4 which device is an aerosol.

8. A device according to claim 3 wherein the susceptible material is at the interface of the valve and the valve actuator.

9. A device according to claim 4 wherein the susceptible material is at the interface of the valve and the valve actuator.

10. A device according to claim 2, wherein the susceptible material is in removable association with the valve stem.

11. A device according to claim 4 wherein the susceptible material is in removable association with the valve stem.

12. A device according to claim 3, wherein the susceptible material is in removable association with the valve actuator.

13. A device according to claim 4 wherein the susceptible material is in removable association with the valve actuator.

14. In a continuous spray propellant device container having an overcap assembly for a container with a valve stem extending upwardly from the center of the can for discharging the container contents through a terminal orifice of the valve stem, the improvement which comprises having in removable association with the overcap's orifice a material susceptible to displacement at ambient temperature by an actuating factor in the container, whereby when the overcap is mounted on the container in the inverted position the material susceptible to displacement in the overcap's orifice is actuated and the susceptible material is displaced by the actuating factor over a period of time, thereby delaying the release of the container product.

15. An overcap according to claim 14 wherein the actuating factor is compressed propellant or a solvent or a combination of compressed propellant and solvent.

16. An overcap according claim 15, wherein said material is a formulated combination of a polymer resin and a plasticizer.

17. An overcap according claim 16, wherein the polymer resin and the plasticizer are present in an amount from 79 wt/% to 83 wt/% of the polymer resin and 17 wt/% to 21 wt/% of the plasticizer.

18. A method for delaying the release of the contents of a continuous-spray propellant device container, which comprises placing a material susceptible to an actuating factor in contact with the actuating factor which is in the device container by engaging a valve and valve actuator of the device, releasing the actuating factor to displace the susceptible material over a period of time.

19. A method according to claim 18 wherein the actuating factor is compressed propellant or a solvent or a combination of compressed propellant and solvent.

20. A method for delaying the release of the contents of a continuous-spray propellant device container, which comprises placing a material susceptible to an actuating factor in contact with the actuating factor which is in the device container by mounting an overcap on the device container in an inverted position, releasing the actuating factor to displace the susceptible material in the overcap over a period of time.

21. A method according to claim 20 wherein the actuating factor is compressed propellant or a solvent or a combination of compressed propellant and solvent.

* * * * *